US005358386A

United States Patent [19]

Koyama et al.

[11] Patent Number: 5,358,386

[45] Date of Patent: Oct. 25, 1994

[54] HERMETIC COMPRESSOR

[75] Inventors: Takashi Koyama, Chigasaki; Takao Yoshimura, Kamakura; Hironari Akashi, Fujisawa; Koh Inagaki, Fujisawa; Ichiro Kita, Fujisawa; Junichiro Yabiki, Chigasaki, all of Japan

[73] Assignee: Matsushita Refrigeration Company, Osaka, Japan

[21] Appl. No.: 112,179

[22] Filed: Aug. 25, 1993

[30] Foreign Application Priority Data

Aug. 26, 1992 [JP] Japan ..... 4-226932

[51] Int. Cl.[5] ..... F04B 21/00

[52] U.S. Cl. ..... 417/312; 417/902; 181/903

[58] Field of Search ..... 417/312, 313, 902; 181/403

[56] References Cited

U.S. PATENT DOCUMENTS

| | | | |
|---|---|---|---|
| 3,169,696 | 2/1965 | Warner | 417/902 |
| 3,279,683 | 10/1966 | Kleiwlein | 417/312 |
| 3,876,339 | 4/1975 | Gannaway | 417/902 |
| 4,313,715 | 2/1982 | Richardson | 417/312 |
| 4,371,319 | 2/1983 | Murayama et al. | 417/312 |
| 4,401,418 | 8/1983 | Fritchman | 417/312 |
| 4,431,356 | 2/1984 | Lassota | 417/902 |
| 4,523,663 | 6/1985 | Bar | 417/312 |
| 4,729,723 | 3/1988 | Outzen | 417/312 |

FOREIGN PATENT DOCUMENTS

| | | |
|---|---|---|
| 2594527 | 8/1987 | France . |
| 49-18245 | 5/1974 | Japan . |
| 353476 | 8/1991 | Japan . |
| 2078311 | 1/1982 | United Kingdom . |
| 2118256 | 10/1983 | United Kingdom . |

*Primary Examiner*—Richard A. Bertsch
*Assistant Examiner*—Peter Korytnyk
*Attorney, Agent, or Firm*—Lowe, Price, LeBlanc & Becker

[57] ABSTRACT

A hermetic compressor includes a sealed casing which accommodates therein a compressing unit for compressing a refrigerant and a driving unit for driving the compressing unit. An induction pipe is provided in the sealed casing for introducing the refrigerant into the compressing unit. The induction pipe has an outlet end communicating with the interior of the compressing unit and an inlet end which is opened to space in the sealed casing at a position corresponding to a node of a standing wave of the refrigerant in the sealed casing.

9 Claims, 5 Drawing Sheets

HERMETIC COMPRESSOR

BACKGROUND OF THE INVENTION

1. Field of the Invention

The present invention relates generally to a hermetic compressor or a closed-type compressor for use in, such as, a refrigerator.

2. Description of the prior Art

Recently, hermetic compressors with reduced noise have been largely demanded in view of the environmental amenity. In order to satisfy such demands, there has been proposed a hermetic compressor having a hermetic or sealed casing of such a shape as to prevent generation of a resonance sound in the sealed casing, as disclosed such as in Japanese Second (examined) Patent Publication No. 3-53476.

Specifically, the proposed conventional sealed casing has a shape such that a straight line drawn from any portion of its inner wall at a right angle intersects with an opposite portion of the inner wall at an angle other than the right angle. This structure serves to prevent generation of resonance in the sealed casing since an acoustic or sound wave reflected by the opposite inner wall portion does not return to the portion where it comes from. Accordingly, this structure serves to prevent increment of the noise which would be otherwise caused by the resonance in the sealed casing, so as to provide the hermetic compressor with reduced noise.

However, the foregoing conventional structure has the following drawbacks:

Specifically, according to the conventional structure, as an angle between the above-noted straight line and the opposite inner wall portion deviates from the right angle by a larger degree, the effect for preventing the generation of resonance in the sealed casing becomes lager. However, in order to provide a larger deviation from the right angle for enhancing such an effect, a shape of the sealed casing has to be distorted unnaturally. As a result, the sealed casing is weakened in strength, which causes increment of the noise caused by vibration of the sealed casing. In addition, since the shape of the sealed casing is forced to be distorted in view of reducing the resonance noise, the space in the sealed casing can not be effectively utilized in comparison with a sealed casing having a normal shape. As a result, the sealed casing undesirably increases in size for accommodating therein a compressing unit and a driving unit which drives the compressing unit.

SUMMARY OF THE INVENTION

Therefore, it is an object of the present invention to provide an improved hermetic compressor with reduced noise that can eliminate the foregoing disadvantages inherent in the conventional hermetic compressors.

To accomplish the above-mentioned and other objects, according to one aspect of the present invention, a hermetic compressor comprises a sealed casing which stores lubricant therein at its lower part; compressing means, provided in the sealed casing, for compressing a refrigerant; driving means, provided in the sealed casing, for driving the compressing means; and induction means for introducing the refrigerant into the compressing means, the induction means having a first end communicating with the compressing means and a second end which is opened to space in the sealed casing at a position on a first plane intersecting with a first line segment at its middle point and in perpendicular thereto, the first line segment having a minimum length among lengths of line segments each extending between arbitrary two points on an internal wall of the sealed casing at a level of a horizontal section of the interior of the sealed casing via a center of gravity of the horizontal section, the horizontal section having a maximum area over a vertical length of the sealed casing.

According to another aspect of the present invention, a hermetic compressor comprises a sealed casing which stores lubricant therein at its lower part; compressing means, provided in the sealed casing, for compressing a refrigerant; driving means, provided in the sealed casing, for driving the compressing means; and induction means for introducing the refrigerant into the compressing means, the induction means having a first end communicating with the compressing means and a second end which is opened to space in the sealed casing at a position on a first plane intersecting with a first line segment at its middle point and in perpendicular thereto, the first line segment extending between arbitrary two points on an internal wall of the sealed casing and in perpendicular to a second line segment on a horizontal plane including the second line segment, the second line segment having a minimum length among lengths of line segments each extending between arbitrary two points on the internal wall of the sealed casing at a level of a horizontal section of the interior of the sealed casing via a center of gravity of the horizontal section, the horizontal section having a maximum area over a vertical length of the sealed casing.

According to still another aspect of the present invention, a hermetic compressor comprises a sealed casing which stores lubricant therein at its lower part; compressing means, provided in the sealed casing, for compressing a refrigerant; driving means, provided in the scaled casing, for driving the compressing means; and induction means for introducing the refrigerant into the compressing means, the induction means having a first end communicating with the compressing means and a second end which is opened to space in the sealed casing at a position on a first plane intersecting with a first line segment at its middle point and in perpendicular thereto, the first line segment having a maximum length among lengths of line segments each extending vertically between an arbitrary upper point on an internal wall of the sealed casing and a level of the lubricant in the sealed casing.

According to a further aspect of the present invention, a hermetic compressor comprises a sealed casing which stores lubricant therein at its lower part; compressing means, provided in the scaled casing, for compressing a refrigerant; driving means, provided in the scaled casing, for driving the compressing means; and induction means for introducing the refrigerant into the compressing means, the induction means having a first end communicating with the compressing means and a second end which is opened to space in the sealed casing at a position corresponding to a node of a standing wave of the refrigerant in the sealed casing, the standing wave being generated due to operation of the compressing means via the induction means.

BRIEF DESCRIPTION OF THE DRAWINGS

The present invention will be understood more fully from the detailed description given hereinbelow and from the accompanying drawings of the preferred embodiments of the invention, which are given by way of example only, and are not intended to be limitative of the present invention.

In the drawings.

DESCRIPTION OF THE PREFERRED EMBODIMENT

Now, preferred embodiments of the present invention will be described hereinbelow with reference to the accompanying drawings.

Figure 1:
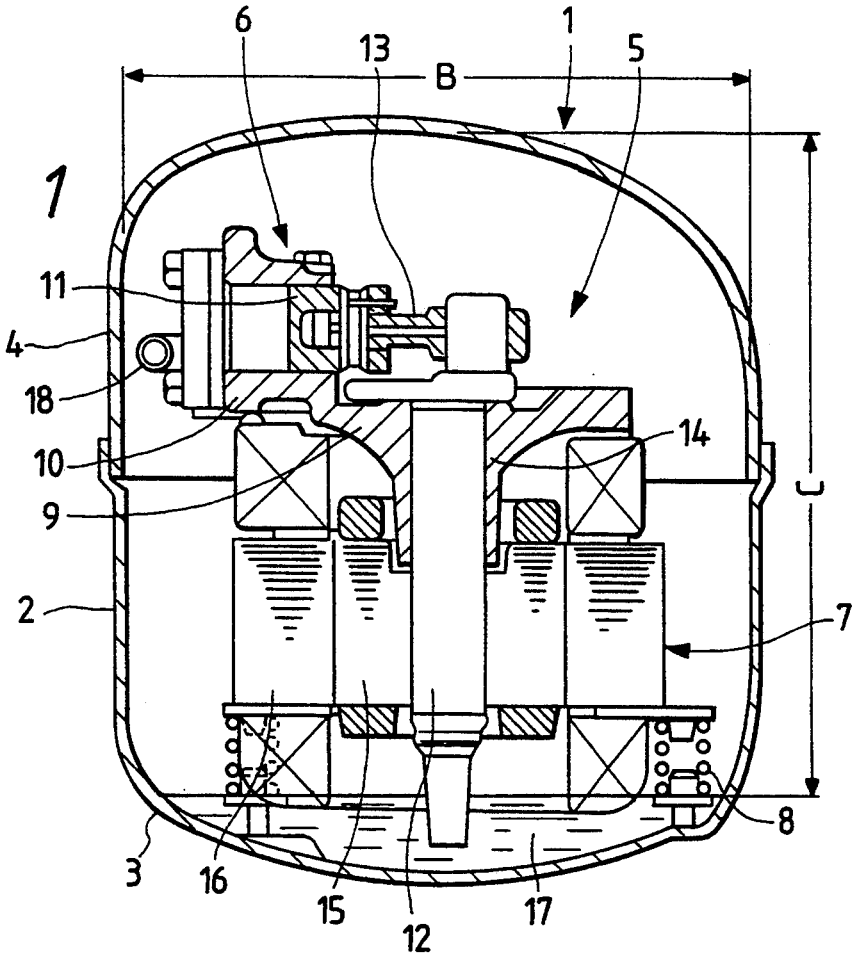
FIG. 1 is a schematic vertical sectional view of a hermetic compressor according to a first preferred embodiment of the present invention.
Figure 2:
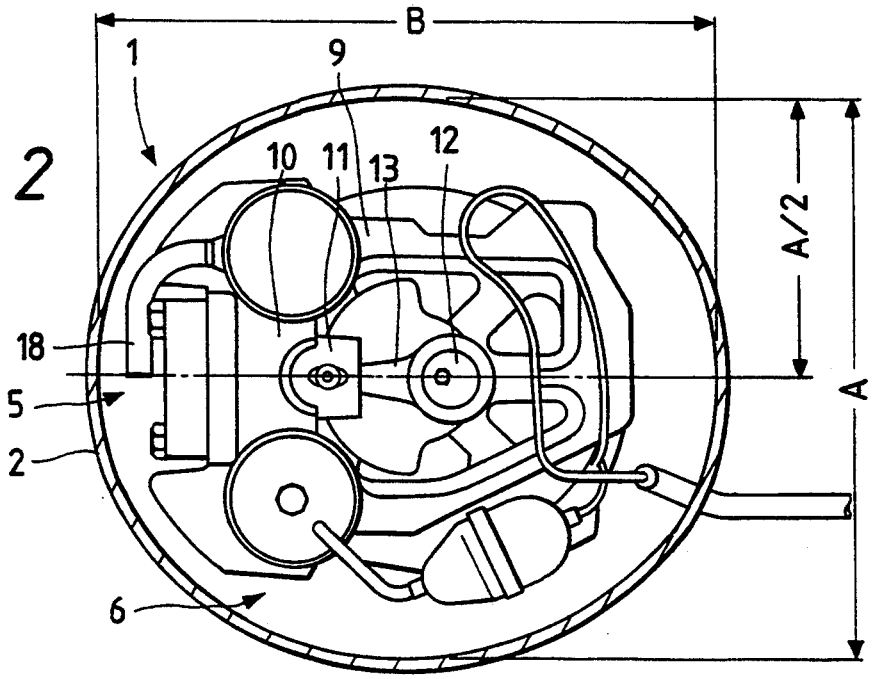
FIG. 2 is a schematic horizontal sectional view of the hermetic compressor according to the first preferred embodiment, wherein components in a sealed casing are illustrated in a top plan view.

FIGS. 1 and 2 respectively show a hermetic compressor 1 according to a first preferred embodiment of the present invention, wherein FIG. 1 is a longitudinal or vertical sectional view of the hermetic compressor 1, and FIG. 2 is a cross-sectional or horizontal sectional view of the hermetic compressor 1 with components in a hermetic or sealed casing 2 being illustrated in a top plan view.

As shown in FIG. 1, the sealed casing 2 is formed by a lower casing member 3 and an upper casing member 4 which are firmly fixed to each other. As shown in FIG. 2, the interior or the interior space of the sealed casing 2 has an oval shape or a substantially elliptic shape in horizontal section. In FIGS. 1 and 2, numeral 5 designates a driving-compressing unit which is resiliently supported by coil springs 8. The driving-compressing unit 5 includes a compressing unit 6 and a driving unit 7. The compressing unit 6 includes, a cylinder 10 formed integral with a base block 9, a piston 11, a crankshaft 12, a connecting rod 13 and a bearing 14. The driving unit 7 includes a rotor 15 and a stator 16 to form a motor. The rotor 15 is fixed to the crankshaft 12 by shrinkage fitting, and the stator 16 is fixed to the base block 9 by screws. Numeral 17 represents lubricating oil stored in the sealed casing 2 at its lower part.

Alphabet A (FIG. 2) represents a minimum horizontal distance among horizontal distances each measured between arbitrary two opposite points on an internal wall of the sealed casing 2 at a level of a certain horizontal section of the interior of the sealed casing 2, via a center of gravity of such a horizontal section. Specifically, this horizontal section is selected so as to have a maximum area over the height or the vertical length of the sealed casing 2, i.e. an area of this horizontal section being maximum among areas of horizontal sections of the interior of the sealed casing 2 over the vertical length of the sealed casing 2. As appreciated, the interior of the sealed casing 2 is defined by the above-noted internal wall of the sealed casing 2. In other words, alphabet A represents a minimum length among lengths of line segments each extending between arbitrary two opposite points on the internal wall of the sealed casing 2 at the level of the above-noted horizontal section via the center of gravity thereof. Alternatively, it may be also defined that alphabet A represents a maximum distance among distances each measured between arbitrary two opposite points on the internal wall of the sealed casing 2 in a direction perpendicular to directions of the reciprocating motion of the piston 11 as well as to an axial direction of the crankshaft 12.

Alphabet B represents a maximum horizontal distance among horizontal distances each between arbitrary two opposite points on the internal wall of the sealed casing 2, as measured in a direction perpendicular to the line segment having the above-noted minimum length A (hereinafter referred to as "minimum length line segment A") on a horizontal plane including this minimum length line segment A, i.e. at the level of the above-noted certain horizontal section of the interior of the sealed casing 2. In other words, alphabet B represents a maximum length among lengths of line segments each extending between arbitrary two opposite points on the internal wall of the sealed casing 2, as measured in a direction perpendicular to the minimum length line segment A on a horizontal plane including this minimum length line segment A, i.e. at the level of the above-noted certain horizontal section of the interior of the sealed casing 2. Alternatively, it may be also defined that alphabet B represents a maximum distance among distances each between arbitrary two opposite points on the internal wall of the sealed casing 2, as measured in the directions of the reciprocating motion of the piston 11.

Alphabet C represents a maximum vertical distance among vertical distances each measured between an arbitrary upper point on the internal wall of the sealed casing 2 and an oil level of the lubricating oil 17 in the sealed casing 2. In other words, alphabet C represents a maximum length among lengths of line segments each extending between an arbitrary upper point on the internal wall of the sealed casing 2 and an oil level of the lubricating oil 17 in the sealed casing 2.

In this preferred embodiment, the following dimensions are set for the distances or lengths A, B and C:

A=138 mm, B=145 mm, C=160 mm

Numeral 18 designates a suction or induction pipe which is fixed to the base block 9 and communicates with the interior of the cylinder 10 at its one end working as an outlet. The suction pipe 18 has the other end, working as an inlet, which is opened to space or room in the sealed casing 2 at a position on a certain plane. This plane intersects with the minimum length line segment A at a middle point thereof and in perpendicular thereto, as clearly shown in FIG. 2.

Now, operations of the hermetic compressor 1 as structured above according to the first preferred embodiment will be described hereinbelow.

A refrigerant which has been circulated through a refrigeration system of, such as, the refrigerator is introduced to the interior of the sealed casing 2 in a known manner. The introduced refrigerant is then sucked into the cylinder 10 via the suction pipe 18 and pressurized or compressed due to the reciprocating motion of the piston 11. Specifically, the refrigerant is sucked into the cylinder 10 during a half (½) rotation of the crankshaft 12, and is pressurized during a subsequent half (½) rotation of the crankshaft 12. Accordingly, since the refrigerant is not sucked into the cylinder 10 in a continuous manner, pressure pulsation of the refrigerant is generated at the suction pipe 18. This pressure pulsation excites the space to cause vibration in the sealed casing 2 so that the compressor 1 has possible resonance modes in directions of the reciprocating motion of the piston 11 and in directions perpendicular to the directions of the reciprocating motion of the piston 11, wherein each of "resonance modes" represents a state of the compressor 1 corresponding to one of the possible resonance frequencies of the compressor 1.

In this preferred embodiment, it has been confirmed through experiments and analyses that a resonance frequency of the resonance mode of the compressor 1 in the direction of the minimum length line segment A (hereinafter referred to as "direction A") becomes 585 Hz which corresponds to a frequency of a pressure pulsation component of the refrigerant (HFC-134a) in the direction A, i.e. a frequency of a standing wave of the refrigerant in the direction A. The frequency of 585 Hz is an integral multiple of a rotational frequency of the driving unit 7 as operated at 50 Hz. As a result, the resonance mode of the compressor 1 in the direction A is satisfied or established.

However, as described above, the suction pipe 18 has the open end or opening at the position on the plane which intersects with the minimum length line segment A at its middle point and in perpendicular thereto. This means that the suction pipe 18 is opened at a position corresponding to a node of the standing wave in the direction A, i.e. at a position on a vertical plane defined by the node of the standing wave in the direction A. Accordingly, the pressure pulsation component of the refrigerant applies vibration at the node of the standing wave in the direction A so that the generation of the resonance is effectively suppressed. Various experiments have shown that a sound of 585 Hz representing the resonance sound is reduced by more than 10 dB by positioning the opening of the suction pipe 18 as described above. This means that increment of the noise of the compressor 1, which would be otherwise caused due to the resonance sound, is effectively prevented in the first preferred embodiment.

Figure 3:
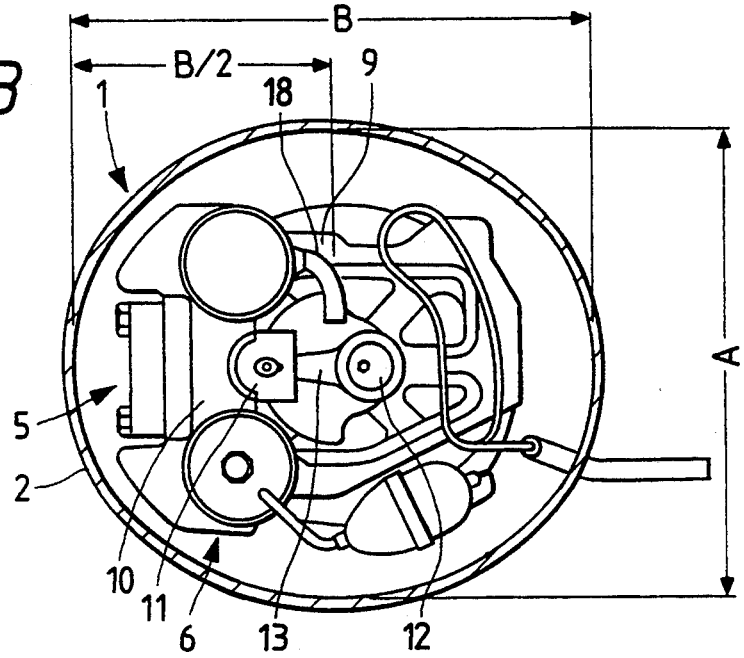
FIG. 3 is a schematic horizontal sectional view of a hermetic compressor according to a first modification of the first preferred embodiment, wherein components in a sealed casing are illustrated in a top plan view.

FIG. 3 is a horizontal sectional view of the hermetic compressor 1, as corresponding to FIG. 2, according to a first modification of the first preferred embodiment. In FIG. 3, the same or corresponding elements and dimensions are designated by the same references as those in FIGS. 1 and 2 so as to avoid redundant disclosure.

In the first modification of FIG. 3, the dimensional relationship among the distances or lengths A, B and C is set such that the resonance mode of the compressor 1 is satisfied or activated in a direction of the line segment having the maximum length B (hereinafter referred to as "direction B").

In FIG. 3, the suction pipe 18 has one end communicating with the interior of the cylinder 10 as in the first preferred embodiment, and the other end being opened at a position on a plane which intersects with the line segment having the maximum length B (hereinafter referred to as "maximum length line segment B") at its middle point and in perpendicular thereto, or which intersects with any one of the line segments at its middle point and in perpendicular thereto, those line segments each extending between arbitrary two opposite points on the internal wall of the sealed casing 2 and in perpendicular to the minimum length line segment A on the horizontal plane. This means that the suction pipe 18 is opened at a position corresponding to a node of a standing wave in the direction B, i.e. at a position on a vertical plane defined by the node of the standing wave in the direction B.

The first modification effectively works to suppress the generation of the resonance sound when the resonance mode of the compressor 1 in the direction B is satisfied, for the reason as described in the first preferred embodiment.

The other structure of the first modification is substantially the same as that in the first preferred embodiment.

Figure 4:
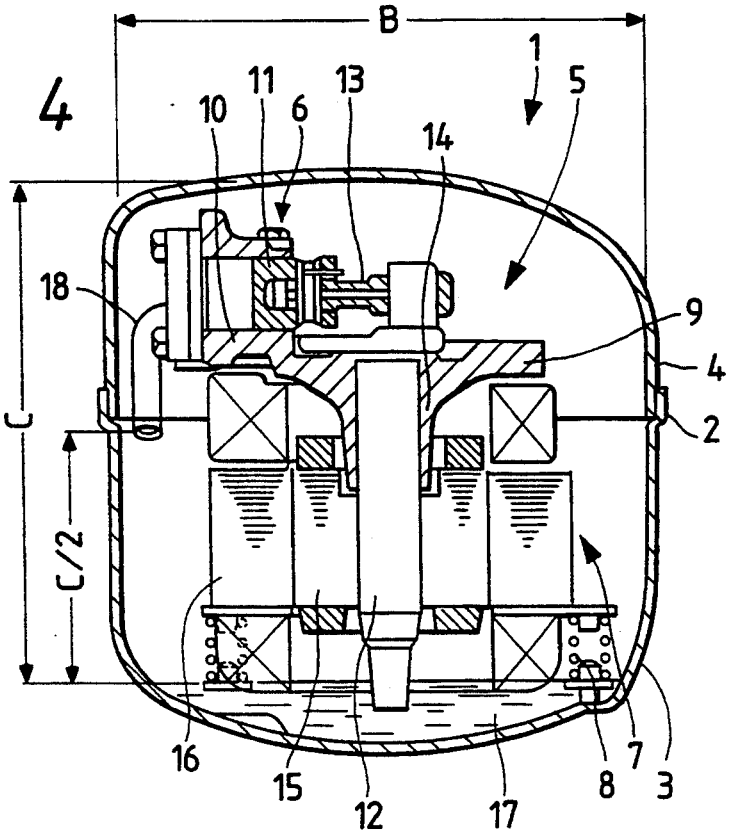
FIG. 4 is a schematic vertical sectional view of a hermetic compressor according to a second modification of the first preferred embodiment.

FIG. 4 is a vertical sectional view of the hermetic compressor 1, as corresponding to FIG. 1, according to a second modification of the first preferred embodiment. In FIG. 4, the same or corresponding elements and dimensions are designated by the same references as those in FIGS. 1 and 2 so as to avoid redundant disclosure.

In the second modification of FIG. 4, the dimensional relationship among the distances or lengths A, B and C is set such that the resonance mode of the compressor 1 is satisfied in a direction of the line segment having the maximum length C (hereinafter referred to as "direction C").

In FIG. 4, the suction pipe 18 has one end communicating with the interior of the cylinder 10 as in the first preferred embodiment, and the other end being opened at a position on a plane which intersects with the line segment having the maximum length C (hereinafter referred to as "maximum length line segment C") at its middle point and in perpendicular thereto. This means that the suction pipe 18 is opened at a position corresponding to a node of a standing wave in the direction C, i.e. at a position on a horizontal plane defined by the node of the standing wave in the direction C.

The second modification effectively works to suppress the generation of the resonance sound when the resonance mode of the compressor 1 in the direction C is satisfied, for the reason as described in the first preferred embodiment.

The other structure of the second modification is substantially the same as that in the first preferred embodiment.

Figure 5:
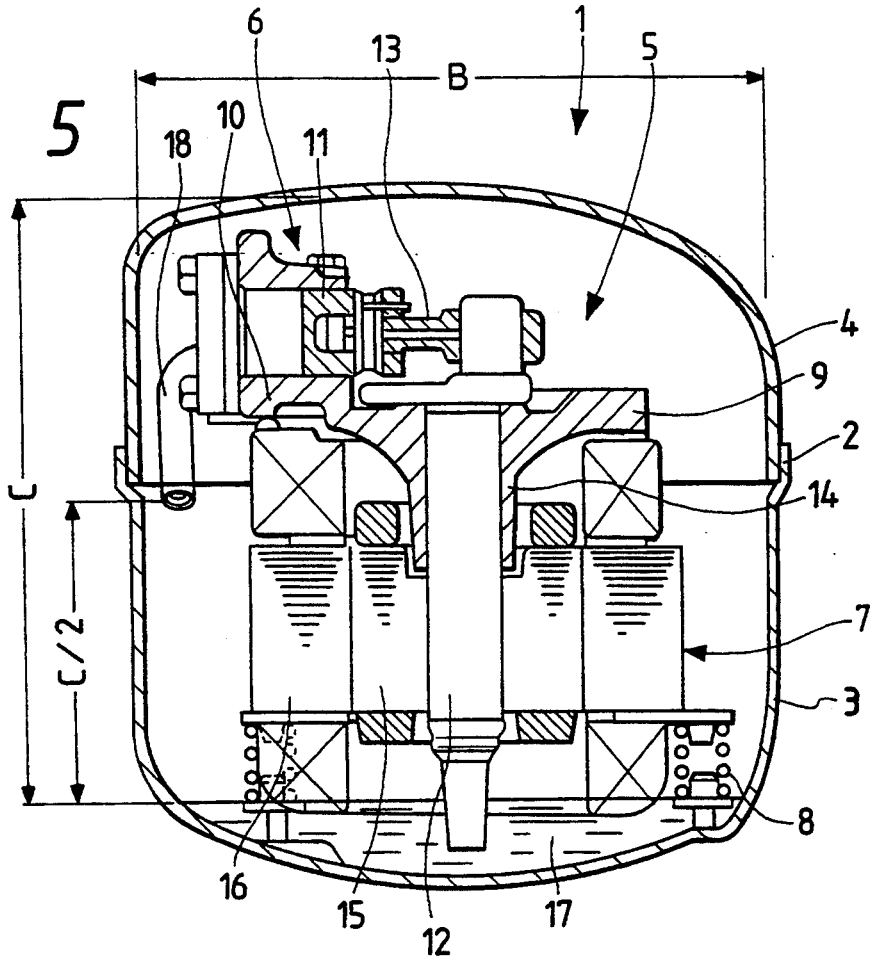
FIG. 5 is a schematic vertical sectional view of a hermetic compressor according to a second preferred embodiment of the present invention.
Figure 6:
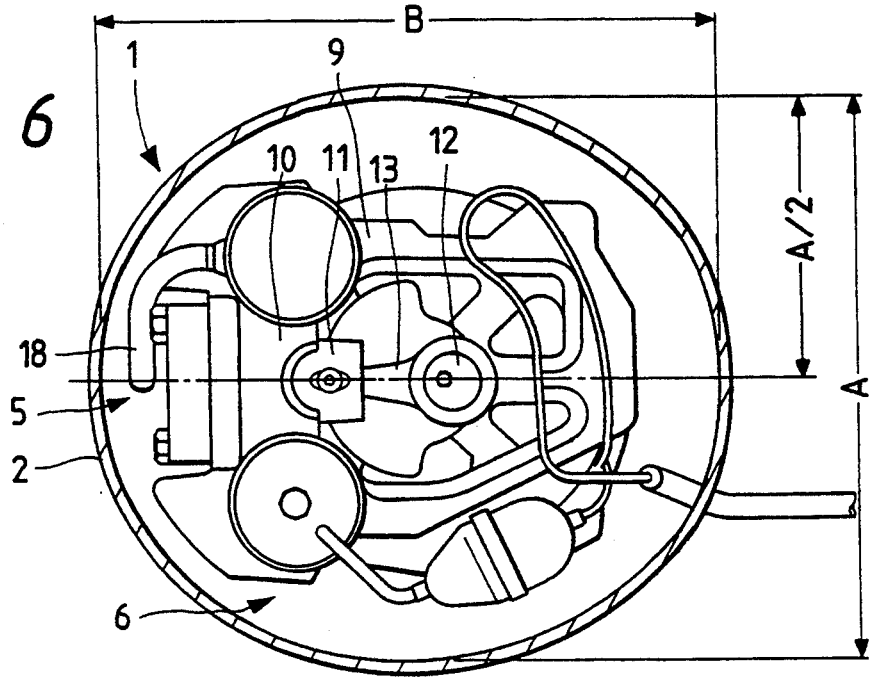
FIG. 6 is a schematic horizontal sectional view of the hermetic compressor according to the second preferred embodiment, wherein components in a sealed casing are illustrated in a top plan view.

Now, a second preferred embodiment will be described with reference to FIGS. 5 and 6, wherein FIG. 5 is a vertical sectional view of the compressor 1, as corresponding to FIG. 1, and FIG. 6 is a horizontal sectional view of the compressor 1, as corresponding to FIG. 2. In FIGS. 5 and 6, the same or corresponding elements and dimensions are designated by the same references as those in FIGS. 1 and 2 so as to avoid redundant disclosure.

In the second preferred embodiment of FIGS. 5 and 6, the dimensional relationship among the distances or lengths A, B and C is set as follows:

A=138 mm, B=145 mm, C=150 mm

In FIGS. 5 and 6, the suction pipe 18 has one end communicating with the interior of the cylinder 10 as in the first preferred embodiment. On the other hand, the suction pipe 18 has the other end being opened at a position on a line of intersection between a plane which intersects with the minimum length line segment A at its middle point and in perpendicular thereto and a plane which intersects with the maximum length line segment C at its middle point and in perpendicular thereto. This means that the suction pipe 18 is opened at a position corresponding to a node of a standing wave in the direction A, i.e. at a position on a vertical plane defined by the node of the standing wave in the direction A, and simultaneously, at a position corresponding to a node of a standing wave in the direction C, i.e. at a position on a horizontal plane defined by the node of the standing wave in the direction C.

In this preferred embodiment, it has been confirmed through experiments and analyses that a resonance frequency of the resonance mode of the compressor 1 in the direction A becomes 585 Hz which corresponds to a frequency of a pressure pulsation component of the refrigerant (HFC-134a) in the direction A, i.e. a frequency of a standing wave in the direction A. The frequency of 585 Hz is an integral multiple of a rotational frequency of the driving unit 7 as operated at 50 Hz. As a result, the resonance mode of the compressor 1 in the direction A is satisfied. It has further been confirmed that a resonance frequency of the resonance mode of the compressor 1 in the direction C becomes 535 Hz which corresponds to a frequency of a pressure pulsation component of the refrigerant (HFC-134a) in the direction C, i.e. a frequency of a standing wave in the direction C. The frequency of 535 Hz is an integral multiple of the rotational frequency of the driving unit 7 as operated at 50 Hz. As a result, the resonance mode of the compressor 1 in the direction C is also satisfied.

However, as described above, in the second preferred embodiment, the suction pipe 18 is opened at the position on the above-noted intersecting line formed by the intersection between the above-noted two planes. Accordingly, the pressure pulsation components of the refrigerant apply vibration at the nodes of the standing waves for both the resonance mode in the direction A and the resonance mode in the direction C so that the generation of the resonance sound is effectively suppressed. As a result, increment of the noise of the compressor 1, which would be otherwise caused due to the resonance sound, is effectively prevented in the second preferred embodiment even when the resonance modes of the compressor 1 in the directions both A and C are satisfied.

The other structure of the second preferred embodiment is substantially the same as that in the first preferred embodiment.

Figure 7:
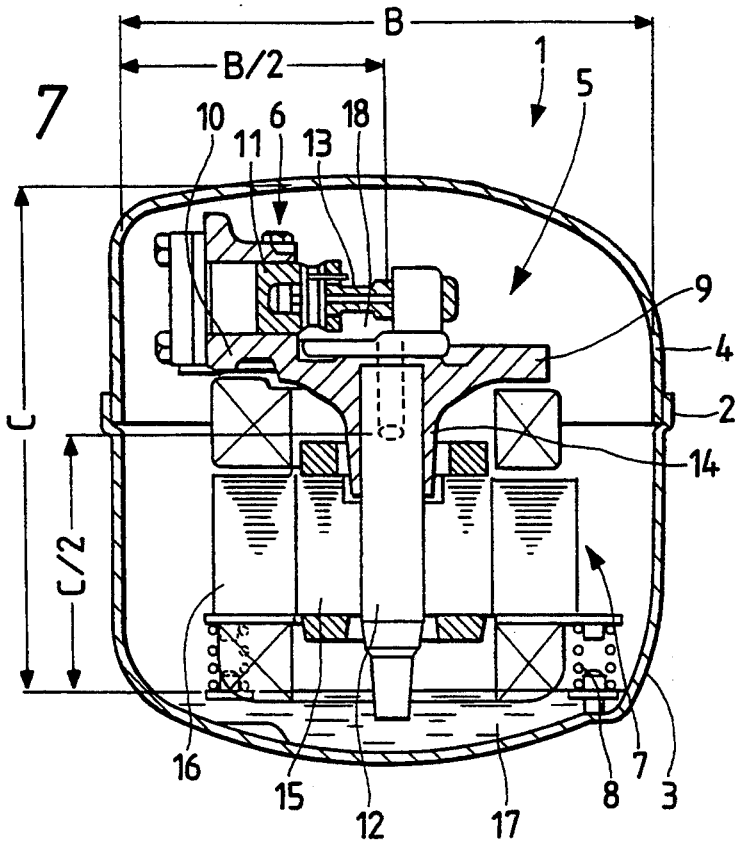
FIG. 7 is a schematic vertical sectional view of a hermetic compressor according to a first modification of the second preferred embodiment.
Figure 8:
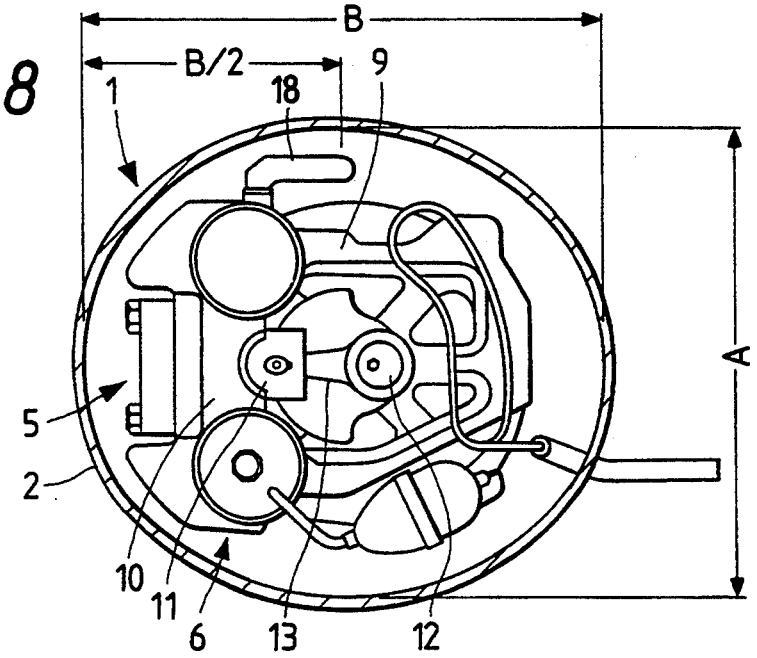
FIG. 8 is a schematic horizontal sectional view of the hermetic compressor according to the first modification of the second preferred embodiment, wherein components in a sealed casing are illustrated in a top plan view.

FIGS. 7 and 8 show a first modification of the second preferred embodiment, and correspond to FIGS. 5 and 6 of the second preferred embodiment, respectively. In FIGS. 7 and 8, the same or corresponding elements and dimensions are designated by the same references as those in FIGS. 5 and 6 so as to avoid redundant disclosure.

In the first modification of FIGS. 7 and 8, the dimensional relationship among the distances or lengths A, B and C is set such that the resonance modes of the compressor 1 are satisfied in the directions B and C.

In FIGS. 7 and 8, the suction pipe 18 has one end communicating with the interior of the cylinder 10 as in the second preferred embodiment. On the other hand, the suction pipe 18 has the other end being opened at a position on a line of intersection between a plane which intersects with the maximum length line segment B at its middle point and in perpendicular thereto or which intersects with any one of the line segments at its middle point and in perpendicular thereto, those line segments each extending between arbitrary two opposite points on the internal wall of the sealed casing 2 and in perpendicular to the minimum length line segment A on the horizontal plane, and a plane which intersects with the maximum length line segment C at its middle point and in perpendicular thereto. This means that the suction pipe 18 is opened at a position corresponding to a node of a standing wave in the direction B, i.e. at a position on a vertical plane defined by the node of the standing wave in the direction B, and simultaneously, at a position corresponding to a node of a standing wave in the direction C, i.e. at a position on a horizontal plane defined by the node of the standing wave in the direction C.

The first modification of the second preferred embodiment effectively works to suppress the generation of the resonance sound when the resonance modes of the compressor 1 in the directions both B and C are satisfied, for the reason as described in the second preferred embodiment.

The other structure of the first modification is substantially the same as that in the second preferred embodiment.

Figure 9:
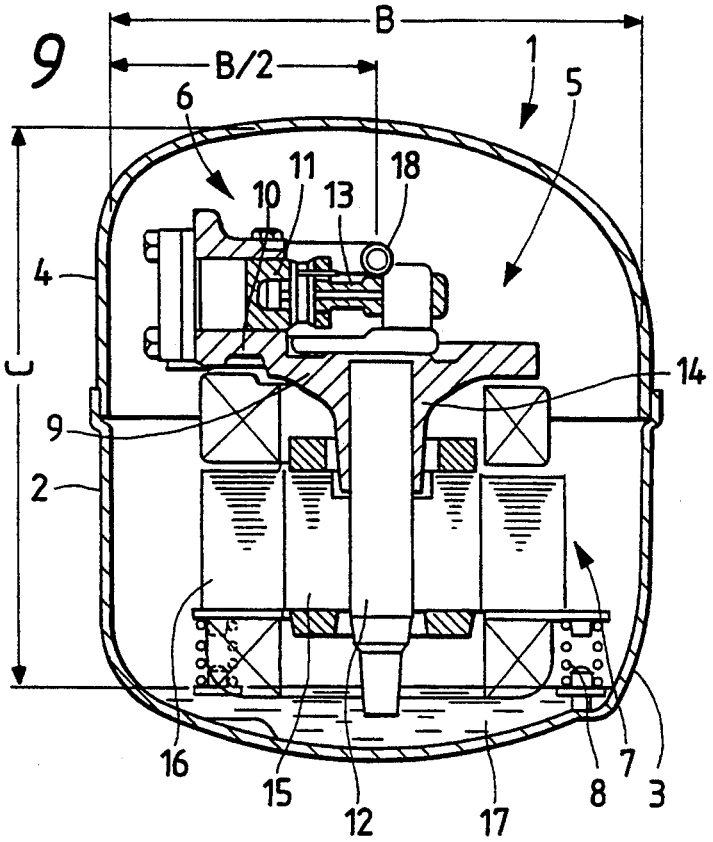
FIG. 9 is a schematic vertical sectional view of a hermetic compressor according to a second modification of the second preferred embodiment.
Figure 10:
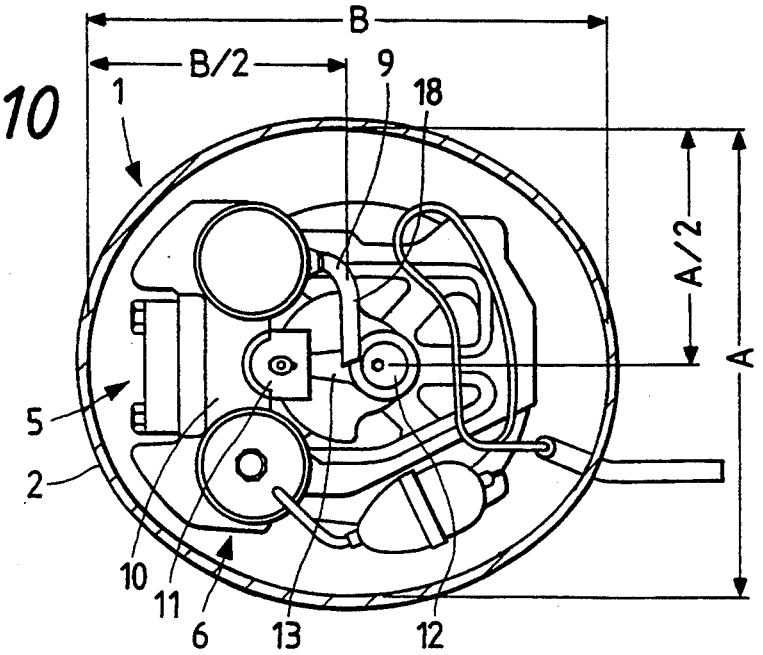
FIG. 10 is a schematic horizontal sectional view of the hermetic compressor according to the second modification of the second preferred embodiment, wherein components in a sealed casing are illustrated in a top plan view.

FIGS. 9 and 10 show a second modification of the second preferred embodiment, and correspond to FIGS. 5 and 6 of the second preferred embodiment, respectively. In FIGS. 9 and 10, the same or corresponding elements and dimensions are designated by the same references as those in FIGS. 5 and 6 so as to avoid redundant disclosure.

In the second modification of FIGS. 9 and 10, the dimensional relationship among the distances or lengths A, B and C is set such that the resonance modes of the compressor 1 are satisfied in the directions A and B.

In FIGS. 9 and 10, the suction pipe 18 has one end communicating with the interior of the cylinder 10 as in the second preferred embodiment. On the other hand, the suction pipe 18 has the other end being opened at a position on a line of intersection between a plane which intersects with the minimum length line segment A at its middle point and in perpendicular thereto and a plane which intersects with the maximum length line segment B at its middle point and in perpendicular thereto or which intersects with any one of the line segments at its middle point and in perpendicular thereto, those line segments each extending between arbitrary two opposite points on the internal wall of the sealed casing 2 and in perpendicular to the minimum length line segment A on the horizontal plane. This means that the suction pipe 18 is opened at a position corresponding to a node of a standing wave in the direction A, i.e. at a position on a vertical plane defined by the node of the standing wave in the direction A, and simultaneously, at a position corresponding to a node of a standing wave in the direction B, i.e. at a position on a vertical plane defined by the node of the standing wave in the direction B.

The second modification of the second preferred embodiment effectively works to suppress the generation of the resonance sound when the resonance modes of the compressor 1 in the directions both A and B are satisfied, for the reason as described in the second preferred embodiment.

The other structure of the second modification is substantially the same as that in the second preferred embodiment.

In a further modification of the second preferred embodiment, wherein the dimensional relationship among the distances or lengths A, B and C is set such that the resonance modes of the compressor 1 are satisfied in the directions A, B and C, the following structure may be arranged:

Specifically, the suction pipe 18 has one end communicating with the interior of the cylinder 10 as in the second preferred embodiment. On the other hand, the suction pipe 18 has the other end being opened at a point of intersection among a plane which intersects with the minimum length line segment A at its middle point and in perpendicular thereto, a plane which intersects with the maximum length line segment B at its middle point and in perpendicular thereto or which intersects with any one of the line segments at its middle point and in perpendicular thereto, those line segments each extending between arbitrary two opposite points on the internal wall of the sealed casing 2 and in perpendicular to the minimum length line segment A on the horizontal plane, and a plane which intersects with the maximum length line segment C at its middle point arid in perpendicular thereto. This means that the suction pipe 18 is opened at a position corresponding to a node of a standing wave in the direction A. i.e. at a position on a vertical plane defined by the node of the standing wave in the direction A, and simultaneously, at a position corresponding to a node of a standing wave in the direction B, i.e. at a position on a vertical plane defined by the node of the standing wave in the direction B, and further simultaneously, at a position corresponding to a node of a standing wave in the direction C, i.e. at a position on a horizontal plane defined by the node of the standing wave in the direction C.

This further modification of the second preferred embodiment effectively works to suppress the generation of the resonance sound when the resonance modes of the compressor 1 in the directions A, B and C are satisfied, for the reason as described in the second preferred embodiment.

It is to be understood that this invention is not to be limited to the preferred embodiments and modifications described above, and that various changes and modifications may be made without departing from the spirit and scope of the invention as defined in the appended claims.

For example, when a muffler or the like is additionally provided at the suction pipe 18, similar effects may be realized by positioning an open end of the muffler as described in the first and second preferred embodiments and their modifications. Further, in a direct-suction-type compressor, similar effects may be realized by positioning a coupling portion between a suction pipe and a muffler as described in the first and second preferred embodiments and their modifications. The coupling portion is provided in the sealed casing using, such as, a spring for connection with a refrigeration system of, such as, the refrigerator.

Further, the present invention is applicable irrespective of a compression manner of the compressor or the number of the cylinders 10. Further, even when the suction pipes 18 are provided in number more than one, similar effects may be realized by arranging the opening of each suction pipe at the position on the foregoing plane or on the foregoing intersecting line or point.

What is claimed is:

1. A hermetic compressor comprising:

a sealed casing which stores lubricant therein at its lower part;

compressing means, provided in said sealed casing, for compressing a refrigerant;

driving means, provided in said sealed casing, for driving said compressing means; and induction means for introducing the refrigerant into said compressing means, said induction means having a first end communicating with said compressing means and a second end which is opened to space in said sealed casing at a position on a first plane intersecting with a first line segment at its middle point and in perpendicular thereto, said first line segment having a minimum length among lengths of line segments each extending between arbitrary two points on an internal wall of said sealed casing at a level of a horizontal section of the interior of said sealed casing via a center of gravity of said horizontal section, said horizontal section having a maximum area over a vertical length of said sealed casing.

2. The hermetic compressor as set forth in claim 1, wherein said position is located on a line of intersection between said first plane and a second plane which intersects with a second line segment at its middle point and in perpendicular thereto, said second line segment extending between arbitrary two points on the internal wall of said sealed casing and in perpendicular to said first line segment on a horizontal plane including said first line segment.

3. The hermetic compressor as set forth in claim 1, wherein said position is located on a line of intersection between said first plane and a second plane which intersects with a second line segment at its middle point and in perpendicular thereto, said second line segment having a maximum length among lengths of line segments each extending vertically between an arbitrary upper point on the internal wall of said sealed casing and a level of said lubricant in said sealed casing.

4. A hermetic compressor comprising:

a sealed casing which stores lubricant therein at its lower part;

compressing means, provided in said sealed casing, for compressing a refrigerant;

driving means, provided in said sealed casing, for driving said compressing means; and induction means for introducing the refrigerant into said compressing means, said induction means having a first end communicating with said compressing means and a second end which is opened to space in said sealed casing at a position on a first plane intersecting with a first line segment at its middle point and in perpendicular thereto, said first line segment extending between arbitrary two points on an internal wall of said sealed casing and in perpendicular to a second line segment on a horizontal plane including said second line segment, said second line segment having a minimum length among lengths of line segments each extending between arbitrary two points on the internal wall of said sealed casing at a level of a horizontal section of the interior of said sealed casing via a center of gravity of said horizontal section, said horizontal section having a maximum area over a vertical length of said sealed casing.

5. The hermetic compressor as set forth in claim 4, wherein said position is located on a line of intersection between said first plane and a second plane which intersects with said second line segment at its middle point and in perpendicular thereto.

6. The hermetic compressor as set forth in claim 4, wherein said position is located on a line of intersection between said first plane and a second plane which intersects with a third line segment, said third line segment having a maximum length among lengths of line segments each extending vertically between an arbitrary upper point on the internal wall of said sealed casing and a level of said lubricant in said sealed casing.

7. A hermetic compressor comprising:

a sealed casing which stores lubricant therein at its lower part;

compressing means, provided in said sealed casing, for compressing a refrigerant;

driving means, provided in said sealed casing, for driving said compressing means; and induction means for introducing the refrigerant into said compressing means, said induction means having a first end communicating with said compressing means and a second end which is opened to space in said sealed casing at a position on a first plane intersecting with a first line segment at its middle point and in perpendicular thereto, said first line segment having a maximum length among lengths of line segments each extending vertically between an arbitrary upper point on an internal wall of said sealed casing and a level of said lubricant in said sealed casing.

8. The hermetic compressor as set forth in claim 7, wherein said position is located on a line of intersection between said first plane and a second plane which intersects with a second line segment at its middle point and in perpendicular thereto, said second line segment having a minimum length among lengths of line segments each extending between arbitrary two points on an internal wall of said sealed casing at a level of a horizontal section of the interior of said sealed casing via a center of gravity of said horizontal section, said horizontal section having a maximum area over a vertical length of said sealed casing.

9. The hermetic compressor as set forth in claim 7, wherein said position is located on a line of intersection between said first plane and a second plane which intersects with a second line segment at its middle point and in perpendicular thereto, said second line segment extending between arbitrary two points on an internal wall of said sealed casing and in perpendicular to a third line segment on a horizontal plane including said third line segment, said third line segment having a minimum length among lengths of line segments each extending between arbitrary two points on the internal wall of said sealed casing at a level of a horizontal section of the interior of said sealed casing via a center of gravity of said horizontal section, said horizontal section having a maximum area over a vertical length of said sealed casing.

* * * * *